US009417611B2

(12) United States Patent
Karapatis et al.

(10) Patent No.: US 9,417,611 B2
(45) Date of Patent: Aug. 16, 2016

(54) TIMEPIECE WITH IMPROVED SOUND LEVEL

(71) Applicant: MONTRES BREGUET SA

(72) Inventors: Polychronis Nakis Karapatis, Premier (CH); Younes Kadmiri, Morre (FR); Davide Sarchi, Renens (CH)

(73) Assignee: Montres Breguet SA, L'Abbaye (CH)

( * ) Notice: Subject to any disclaimer, the term of this patent is extended or adjusted under 35 U.S.C. 154(b) by 0 days.

(21) Appl. No.: 14/895,388

(22) PCT Filed: Sep. 4, 2014

(86) PCT No.: PCT/EP2014/068803

§ 371 (c)(1),
(2) Date: Dec. 2, 2015

(87) PCT Pub. No.: WO2015/043905

PCT Pub. Date: Apr. 2, 2015

(65) Prior Publication Data

US 2016/0109857 A1 Apr. 21, 2016

(30) Foreign Application Priority Data

Sep. 26, 2013 (EP) ..... 13186154

(51) Int. Cl.
*G04B 21/00* (2006.01)
*G04B 21/08* (2006.01)
*G04B 37/00* (2006.01)

(52) U.S. Cl.
CPC ..... *G04B 37/0075* (2013.01); *G04B 21/00* (2013.01); *G04B 21/08* (2013.01)

(58) Field of Classification Search
CPC ..... G04B 21/00; G04B 21/005; G04B 21/06; G04B 21/08; G04B 37/0075
See application file for complete search history.

(56) References Cited

U.S. PATENT DOCUMENTS 3,125,987 A * 3/1964 Jumghans ..... G04B 21/08 116/169
3,462,943 A * 8/1969 Micheloud ..... G04C 21/02 368/244

(Continued)

FOREIGN PATENT DOCUMENTS

CH 497 017 A 9/1970
CH 497 760 A 10/1970

(Continued)

OTHER PUBLICATIONS

International Search Report issued Mar. 6, 2015 for PCT/EP2014/068803 filed on Sep. 4, 2014.

*Primary Examiner* — Vit W Miska
(74) *Attorney, Agent, or Firm* — Oblon, McClelland, Maier & Neustadt, L.L.P.

(57) ABSTRACT

A method for improving sound output level of a musical or striking timepiece including at least one vibration generator and vibrating at specific natural frequencies of the generator. The timepiece includes external parts which are modified by integration or addition of at least one acoustic radiator including at least one element vibrating-radiating at a natural frequency of the radiator tuned to at least one of the natural frequencies of the generator. The external parts include at least one acoustic radiator including at least one element vibrating at a natural frequency of the radiator tuned to at least one of the natural frequencies of the generator.

31 Claims, 3 Drawing Sheets

(56) References Cited

U.S. PATENT DOCUMENTS

| | | | | |
|---|---|---|---|---|
| 3,530,463 | A * | 9/1970 | Spadini | G04B 19/14 340/384.73 |
| 4,216,650 | A | 8/1980 | Hara et al. | |
| 2011/0228647 | A1 | 9/2011 | Karapatis et al. | |
| 2012/0140602 | A1 | 6/2012 | Favre et al. | |
| 2012/0140603 | A1 | 6/2012 | Sarchi et al. | |
| 2012/0147715 | A1 * | 6/2012 | Karapatis | G04B 21/06 368/267 |
| 2012/0243389 | A1 | 9/2012 | Sciascia et al. | |

FOREIGN PATENT DOCUMENTS

| | | | |
|---|---|---|---|
| CH | 645 236 | A | 9/1984 |
| CH | 703 165 | A2 | 11/2011 |
| EP | 2 034 376 | B1 | 3/2010 |
| EP | 2 367 078 | A1 | 9/2011 |
| EP | 2 461 219 | A1 | 6/2012 |
| EP | 2 461 220 | A1 | 6/2012 |
| EP | 2 503 417 | A1 | 9/2012 |
| FR | 1136675 | A | 5/1957 |
| FR | 2777095 | A1 | 10/1999 |
| FR | 2367079 | B1 | 9/2011 |

* cited by examiner

TIMEPIECE WITH IMPROVED SOUND LEVEL

CROSS-REFERENCE TO RELATED APPLICATIONS

This is a National phase Application in the United States of International patent application PCT/EP2014/068803 filed Sep. 4, 2014 which claims priority on European patent application No. 13186154.4 filed Sep. 26, 2013. The entire disclosures of the above patent applications are hereby incorporated herein by reference.

FIELD OF THE INVENTION

The invention concerns a method for improving the sound level of a timepiece, or a musical timepiece or a striking timepiece, including at least one generator of vibrations in the range from 1 kHz to 6 kHz.

The invention also concerns the external parts of a timepiece, or of a musical or striking timepiece, carrying at least one vibration generator.

The invention further concerns a timepiece which is a striking watch and/or a musical box watch.

The invention concerns the field of timepieces, and more particularly timepieces including means for generating vibrations within the audible sound range, notably striking watches and musical box watches.

BACKGROUND OF THE INVENTION

Among complicated timepieces, striking watches are particularly popular. However, their small volume often limits sound emission, and the user has to pay particular attention to hear the acoustic message properly.

There are known specific watch supports acting as a sound box, on which the user places his watch when he wishes to hear the sound produced by the watch better, and which do not fall within the scope of the present invention.

There are known cases or case middles including resonant chambers on which are mounted the sound producing organs, gongs or vibration plates, as in FR Patent Application No 2777095A1 in the name of CHRISTOPHE CLARET SA wherein, in some variants, membranes are placed in contact with walls of such resonant chambers, which take up a large part of the available internal volume inside the case or case middle.

EP Patent No 2034376B1 in the name of ROTH ET GENTA SA attempts to overcome this problem of space, by proposing a thin case middle as a resonator, including lugs for securing gongs or suchlike.

CH Patent Application No 645236G in the name of BOUILLE discloses a case including peripheral lugs intended for mechanical fasteners: due to this specific function, they have increased mechanical rigidity. The geometric shapes, fastenings and orientation of such lugs are well defined and acoustically inefficient, and they could not serve as external acoustic resonators.

There are also known acoustic resonators where sounds are produced by a membrane which is caused to vibrate by an elastic strip, and whose vibrations are maintained by an electromagnetic transducer, as in CH Patent Nos 497760 and 497017, in the name of SPADINI, which have substantial dimensions and require an electric circuit.

To improve the sound level of a striking watch, it is necessary to optimise the elements that form the external parts of the watch, so that they radiate the frequencies generated by the striking system, i.e. in general the natural frequencies of the strips of a vibration plate, or the natural frequencies of a gong or minute repeater. To obtain a rich sound (in the case of a minute repeater) or a sound of uniform intensity regardless of the notes played (in the case of a musical box watch), the external parts must be able to respond to a broad range of frequencies between 1 kHz and 6 kHz, which are the frequencies at which perception by the human ear is optimal.

However, because of their size, shape and rigidity, the natural modes of the external parts of a watch are mainly at a high frequency. In such case, the external parts filter rather than radiate the frequencies of the strike sound or melody.

It is known to optimise the external parts so that they radiate a single given frequency within the frequency band concerned (1 kHz-6 kHz), as in FR Patent Application No 1136675A in the name of Gebrueder JUNGHANS A. G., which discloses the use of a standard membrane for a striking clock, or so that the external parts radiate several modes within the frequency band concerned (1 kHz-6 kHz), as in EP Patent Application No 2461219A1 in the name of MONTRES BREGUET SA disclosing the use of an optimised spatially in homogeneous membrane, or also in EP Patent No 2367079B1 in the name of MONTRES BREGUET SA, which discloses a solution wherein the watch crystal forms the vibrating, radiating member, owing to a particular arrangement for securing the crystal to the bezel.

In the state of the art, and for conventional watch designs, it is, however, impossible to obtain acoustic resonance of the external parts at a frequency of less than 1500 Hz, because the main function of the external components is to ensure protection of the movement, and generally, the sealing of the watch, and they must therefore be sufficiently rigid and thick. For the same reason, it is impossible to greatly increase the number of acoustic resonances of the external parts within the audible frequency range concerned (from 1 kHz to 6 kHz), which considerably limits the sound level and the richness of the sounds emitted and melodies played.

SUMMARY OF THE INVENTION

The invention proposes to provide an improvement of the sound level and the richness of the sound and melodies played by a timepiece, particularly a striking or musical watch, without impairing the quality of the sound transmitted by the mechanism or the transmitter circuit. The invention also makes it possible to selectively filter a portion of the noise produced by the mechanism of a timepiece, notably a watch.

In an innovative manner, the invention integrates additional vibrating-radiating elements in conventional external parts, these additional elements are dimensioned such that the frequencies of their first natural modes (hereafter the "frequencies of the radiator") are tuned to the natural frequencies (hereafter the "frequencies of the generator") of the vibration generator of the timepiece, particularly a watch, notably of a gong, or the strips of a vibration plate to improve the overall sound level of the timepiece, notably a watch. The geometries (surface, thickness, shape) of these additional elements allow acoustic radiation waves to form.

Thus, conventional external parts can be dimensioned according to the constraints imposed by the timepiece design, by the study of style, by the size of the movement, and in order to respond to specifications, such as water-resistance and shock resistance, with no particular regard to the radiating power of the external parts, which is improved, according to the invention, by the addition of these vibrating elements (hereafter the "acoustic radiators"). whose dimensions are optimised exclusively for the sound radiation function.

To this end, the invention concerns a method for improving the sound output level of a timepiece, or of a musical or striking timepiece, including at least one vibration generator vibrating at particular natural frequencies of the generator, within a range from 1 kHz to 6 kHz, characterized in that the external parts and/or a movement of said timepiece are modified by the integration or addition of at least one acoustic radiator including at least one vibrating-radiating element having a natural frequency of the radiator tuned to one of the natural frequencies of the generator.

The invention further concerns external parts for a timepiece, or for a musical or striking timepiece, said external parts being characterized in that they include at least one acoustic radiator including at least one element vibrating-radiating at a natural frequency of the radiator tuned to at least one of the natural frequencies of the timepiece generator.

The invention further concerns a timepiece, which is a striking watch and/or a musical box watch, characterized in that it includes such external parts, and/or a movement carrying at least one vibration generator vibrating at particular natural frequencies of the generator, said movement including at least one acoustic radiator including at least one element vibrating-radiating at a natural frequency of the radiator tuned to at least one of said natural frequencies of the generator.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1A:
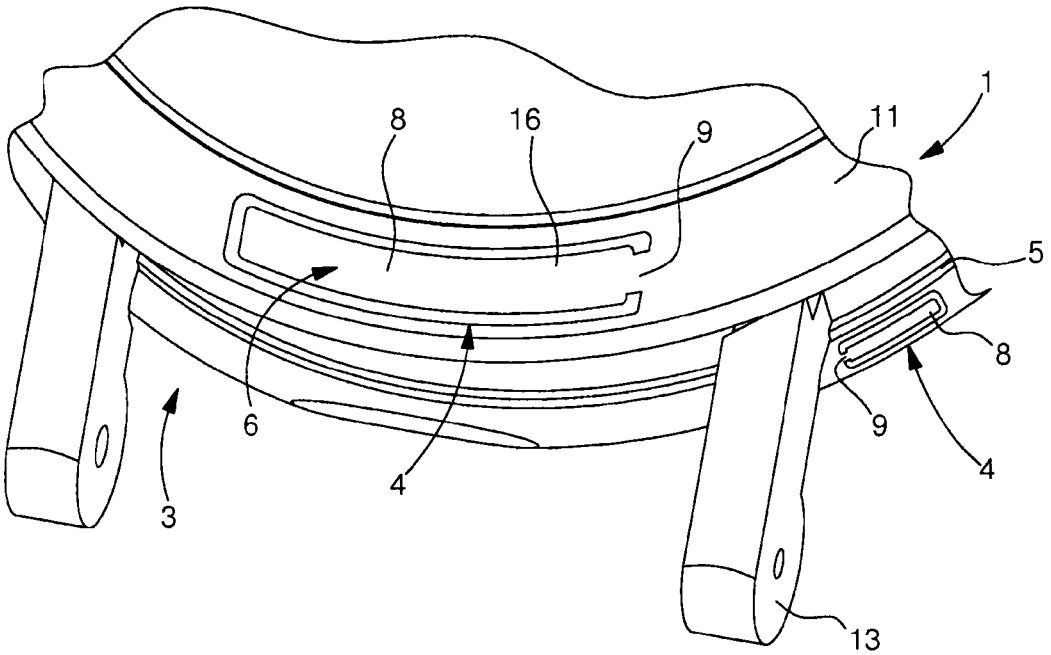
FIG. 1A shows a schematic, partial, perspective view of a timepiece formed by a watch, optimised according to the invention by the integration of acoustic radiators comprising radiating plates, integrated in the case middle and in the bezel of the watch.

The invention concerns the field of timepieces, and more particularly timepieces that include sound emission means, and more particularly striking watches and musical box watches, which will be referred to below as "musical watches", and it proposes to provide means for increasing the sound level and the sound volume.

The present description more particularly concerns such musical watches. Those skilled in the art will know how to use the invention, as it is described, for timepiece or watches that are not musical or have no striking mechanism, for example in order, depending on the case, to make all or part of the sound generated by the watch mechanism audible to the user, or conversely, to filter and make the noise generated by the mechanism inaudible (by utilising the phenomenon of anti-resonance introduced by a vibrating coupling between the acoustic radiators according to the invention described below and the other external parts of the watch).

The invention concerns an improvement relating both the design of musical watches and to the modification of existing musical watches, in order to optimise their sound level.

Thus, the invention concerns a method for improving the sound output level of a timepiece 1, or of a musical or striking timepiece, including at least one vibration generator 2 vibrating at particular natural frequencies, referred to here as "natural frequencies of the generator". This vibration generator 2 may include a gong, a vibration plate, a membrane, a sound box, or similar, vibrating at specific natural frequencies within the effective acoustic band, namely at frequencies comprised between 1 kHz and 6 kHz. The frequencies of vibration of the generator element will be referred to here as the "frequencies of the generator" and the frequencies of vibration of a radiating element, which is described below, as the "frequencies of the radiator".

This vibration generator 2 is carried by the external parts 3 of timepiece 1 or by a movement 17 of timepiece 1.

According to the invention, the particular natural frequencies of the generator are determined: the particular natural frequencies of the generator are precisely calculated (FEM simulation or similar), and at least one radiating element, which is an acoustic radiator 4, is integrated or added to the design and to the construction of external parts 3 and/or of movement 17, and particularly but not restrictively to the exterior of said external parts 3 and/or of said movement 17.

This acoustic radiator 4 includes at least one vibrating-radiating element, which vibrates at a natural frequency of the radiator which is tuned to one of the natural frequencies of the generator of vibration generator 2, with a frequency difference of less than or equal to the ratio between the natural mode frequency and the inverse quality factor of the radiating element, or with a frequency difference of less than or equal to 100 Hz.

In a particular implementation, the natural frequency of the radiator is tuned to one of the natural frequencies of the generator, with a frequency difference of less than or equal to the smallest value between, on the one hand the ratio between the natural mode frequency and the inverse quality factor of the radiating element, and on the other hand the value of 100 Hz.

"Tune" means here to adjust one frequency to a substantially equal frequency, with a frequency difference of less than a calculated or predetermined value; the term "substantially equal" depends on the vibroacoustic resonance width of the radiating element and therefore on its quality factor.

The frequency of the radiator of the fundamental natural mode of the radiating element, here acoustic radiator 4, is tuned to the frequency of the generator of a natural vibration mode of vibration generator 2. This tuning rule can be formulated differently by stating that the frequency of the radiator of the fundamental natural mode of the radiating element is substantially equal to the frequency of the generator of a natural vibration mode of vibration generator 2, the difference between the two frequencies being less than the ratio between the frequency of the radiator and the quality factor of the radiating element evaluated at the frequency of the radiator.

It must be understood that the term "tune" employed in the present description refers to the vibroacoustic resonance capacity of the radiating element, formed by acoustic radiator 4, when it is stressed at the vibration frequency of the generating element formed by vibration generator 2. This term therefore takes no account of any musical characteristics.

Figure 3:
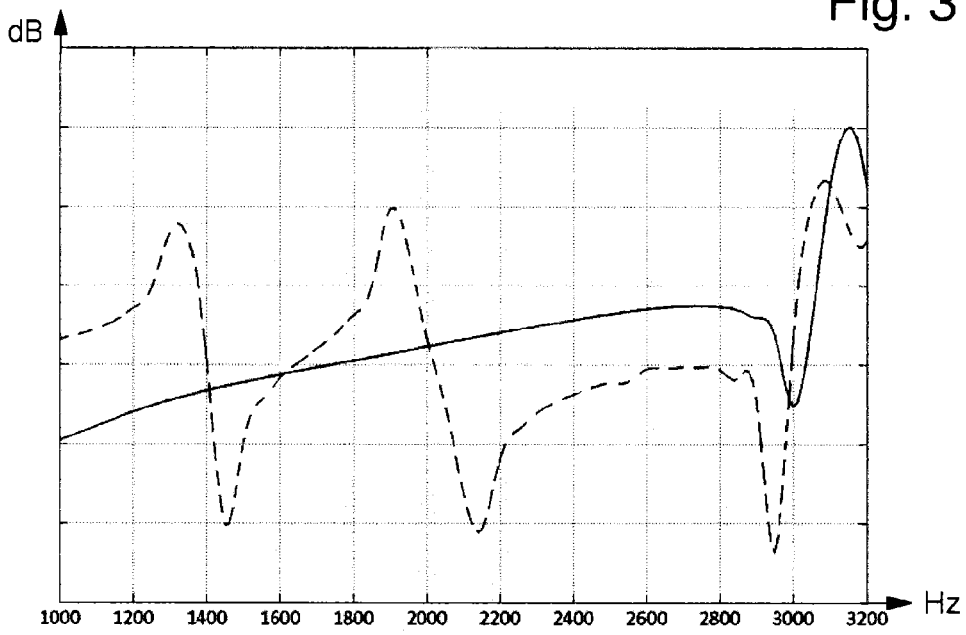
FIG. 3 shows a diagram with frequencies in Hz on the abscissa, and the sound level in dB on the ordinate, measured at 5 cm from the watch on the main axis of the watch, with the same external watch parts, in a continuous line for a conventional embodiment, and in a dash line for a first optimised embodiment where the same external parts are equipped with acoustic radiators according to the invention; this diagram is shown in an application where the first natural mode of the acoustic radiators is at 1350 Hz. The diagram shows the resonance effect of the radiator at the desired frequency and the anti-resonance effect (filtering, sound reduction) in the rest of the frequency band.
Figure 4:
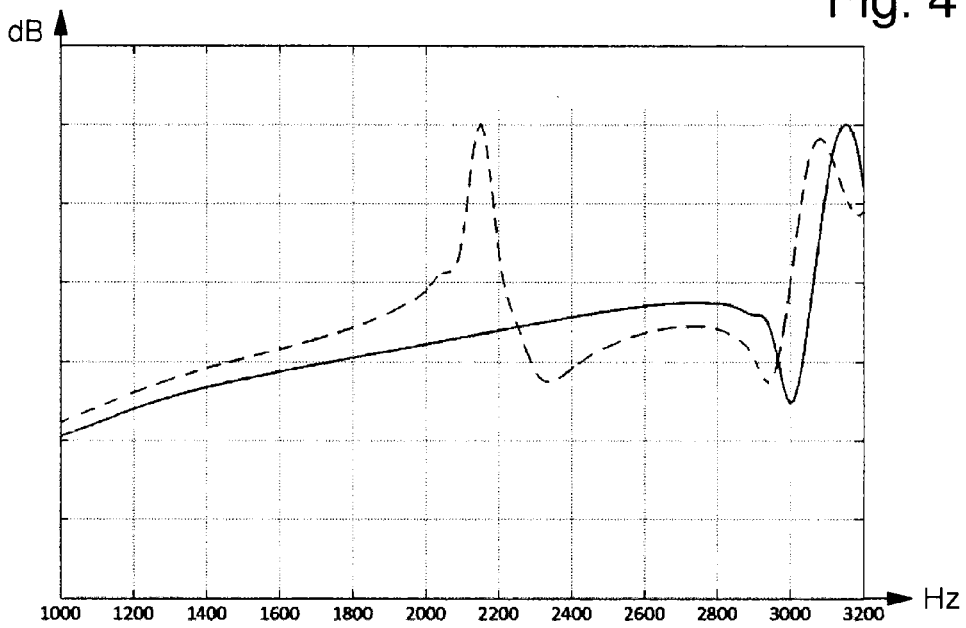
FIG. 4 shows, in a similar manner to FIG. 2A, the same external parts, according to a second optimised embodiment, wherein the parts are provided with acoustic radiators having a first natural mode at 2210 Hz.
Figure 5:
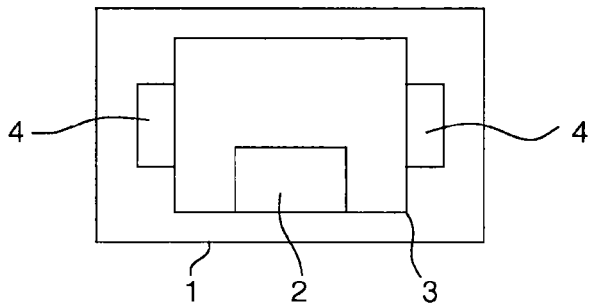
FIG. 5 shows block diagrams of a timepiece including optimised external parts according to the invention.

Consequently, it is possible to tune a frequency of the generator to a frequency of the radiator with a frequency difference of less than or equal to 100 Hz, if the radiating element quality factor is less than or equal to 10, which is generally possible, as shown in FIGS. 3 and 4.

Factor quality Q is defined as the ratio between, on the one hand, the mechanical energy stored in a vibrating element (sum of the elastic energy and kinetic energy), and on the other hand, the energy lost through damping during one complete oscillation.

In one oscillation, $Q=2.\pi.$ (Stored energy/Lost energy)

The quality factor is also defined, in the same manner, as the ratio between the frequency of the natural mode of vibration and the resonant bandwidth of the vibrating element. The vibrating element responds (thus it starts to vibrate strongly) if excitation is imparted thereto at a frequency which is within a frequency range around the frequency of the natural mode of vibration: this frequency range is the bandwidth (the peak width in FIGS. 3 and 4). Mathematically: $Q=f/(f2-f1)$, f1 and f2 define the extremes of the frequency range.

The frequency difference with respect to the frequency of the generator, to which tuning is required, is thus less than or equal to the ratio between the natural mode frequency and the inverse quality factor of the radiating element.

The default maximum value of this frequency difference can be taken as 100 Hz.

This definition takes account of the fact that the quality factor Q of the generating element is always between 5 and 100 times greater than that of the radiating element, and it is generally comprised between 8 and 30 for the mechanisms concerned by the invention.

Thus the radiating element resonates if it is stressed by a vibration at the frequency of the generator $f_A$, which is tuned in accordance with the above definition, or substantially equal, to use watchmaking terminology, to its fundamental frequency, as shown for example in FIGS. 3 and 4, where the frequency response range of the radiating element is on the order of 100 Hz: the difference between the frequency of the radiating element and the frequency of the generating element may thus be 100 Hz.

It is not necessary for all the frequencies of vibration (an infinite number of harmonics) of the radiating element to be substantially equal to one of the frequencies of vibration of the generating element.

On the contrary, according to the most advantageous variant of the invention, a plurality of radiating elements, of number N, is secured to timepiece 1, notably a watch. N is the number of modes of vibration of the generating element required to radiate, and each radiating element has a fundamental mode of vibration whose frequency is substantially equal to the frequency of one of the modes of the generating element.

For example, for a gong having four modes of vibration in the frequency range between 1 kHz and 6 kHz, four acoustic radiators 4 formed of radiating plates are added to the exterior of the case of timepiece 1, notably a watch, each of these four plates having a fundamental natural mode of vibration whose frequency is substantially equal, according to the above definition, to one of the frequencies of vibration of the gong between 1 kHz and 6 kHz.

In another example, for a vibration plate having ten strips (each having a mode of vibration in the frequency range between 1 kHz and 6 kHz), ten acoustic radiators 4, formed of radiating plates, are added to the exterior of the case of timepiece 1, notably a watch, each of these ten plates having a fundamental natural mode of vibration whose frequency is substantially equal to one of the frequencies of vibration of the vibration plate strips.

Thus, to improve the radiation of a timepiece 1, notably a watch, those skilled in the art implement a method including, in order to determine the number of acoustic radiators 4, the following steps:

determining the number N of modes of vibration of the generating element, formed by the vibration generator 2 which is required to radiate;

providing timepiece 1 with a number N of radiating elements, each formed by an acoustic radiator 4 including at least one vibrating-radiating element, each acoustic radiator 4 being secured to the exterior of the case of timepiece 1;

ensuring that the only function of each acoustic radiator 4 is to radiate;

preferably orienting each acoustic radiator 4 in a particular listening direction for which timepiece 1 is devised; in said particular listening direction there is assumed to be a user listening to the strike sound and/or music emitted by timepiece 1;

optimising each acoustic radiator 4 to ensure that the frequency of its fundamental natural mode is tuned to be substantially equal to that of one of the natural modes of vibration of the generating element;

ensuring that each acoustic radiator 4 is distinct from the generating element (their frequencies are different except for the substantially equal frequency that is required to radiate, their quality factors are different, there is no phase relation between the vibration of acoustic radiator 4 and the vibration of the generating element).

Acoustic radiators 4 according to the invention have a radiating function if they are positioned on the exterior of the case of timepiece 1, notably a watch; if they are disposed on the interior, their function is instead to filter (reduce noise) at the frequency concerned.

This acoustic radiator 4 and the mechanical connections thereof to timepiece 1 are numerically dimensioned to have a natural mode of vibration whose frequency is tuned to within 100 Hz of at least one of the natural frequencies of the generator, and whose spatial deformation permits the generation of an acoustic radiation wave. The radiating conditions of structures are presented for example in the work by C Lesueur, "Rayonnement acoustique des structures: vibroacoustique, interactions fluide-structure", Editions Eyrolles, 1988.

Preferably, external parts 3 and/or movement 17 are modified by the integration or addition of a plurality of such acoustic radiators 4, each introducing a natural frequency of the radiator tuned to within 100 Hz of one of the frequencies of the generator of the vibration generator.

In a particular implementation of the invention, at least a portion of these acoustic radiators 4 are selected with natural frequencies of the radiator that are different from each other.

In a particular implementation of the invention, at least a portion of these acoustic radiators 4 are selected with natural frequencies of the radiator that are equal to each other.

It is understood that it is also possible to mix these two implementations of the invention, by selecting several groups of acoustic radiators 4, each group formed of acoustic radiators 4 tuned to the same natural frequency of the radiator, and the natural frequencies of the radiator of different groups being different from each other.

In an advantageous embodiment, there is selected, within a given frequency range in the range audible to the human ear, and for each of the natural frequencies of the generator generated by at least one vibration generator 2, at least one such acoustic radiator 4 with a natural frequency of the radiator tuned to one of the natural frequencies of the generator.

Advantageously, at least one such acoustic radiator 4 is made with a main vibrating surface 6, which is oriented in a preferred direction, notably the main axis of the watch corresponding to the pivot axis of the hands, to enhance the diffusion of sound towards the user, notably through external parts 3.

The use of acoustic radiators 4 must not complicate handling of the timepiece components, notably a watch, during assembly or maintenance. Also, preferably and in a non-limiting manner, at least one such acoustic radiator 4 is secured to a case middle 5 comprised in external parts 3, or to a case 10 comprised in external parts 3, or to a bezel 11 carried by one such case middle 5, or to a main plate 14 comprised in timepiece 1. Advantageously, at least one such acoustic radiator 4 is arranged on the exterior of case middle 5 or inside case 10 so that acoustic radiators 4 are not in direct contact with the user.

To obtain good vibrations for each acoustic radiator 4, at least one said acoustic radiator 4 is connected to case middle 5 or to case 10 by an attachment leg 7, of which there is preferably only one, carrying at least one vibrating strip 8 of acoustic radiator 4. FIG. 1B shows vibrating strips 8 connected by one or two attachment legs 7 to case middle 5.

Figure 2A:
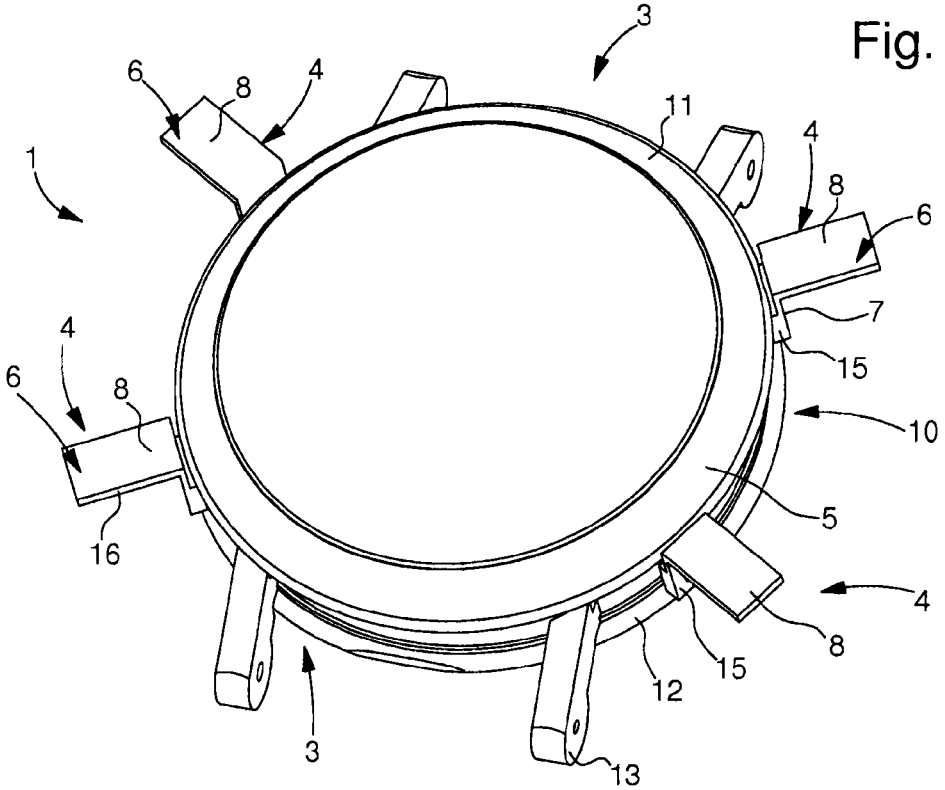
FIG. 2A shows a schematic, perspective view of a particular variant embodiment of the invention, with four, substantially radial, acoustic radiators secured to the watch case, with main vibrating surfaces facing the user.

FIG. 2A shows an embodiment of the invention wherein four acoustic radiators 4 are formed by four rectangular strips 8 secured to case 10 of timepiece 1, each being connected by one such attachment leg 7, these strips 8 being substantially radiating and with substantially coplanar main vibrating surfaces 6. Radiators 4 are free to vibrate in their first mode of vibration and to create an acoustic radiation wave which propagates in the direction of the axis of the timepiece, notably a watch 1.

Figure 1B:
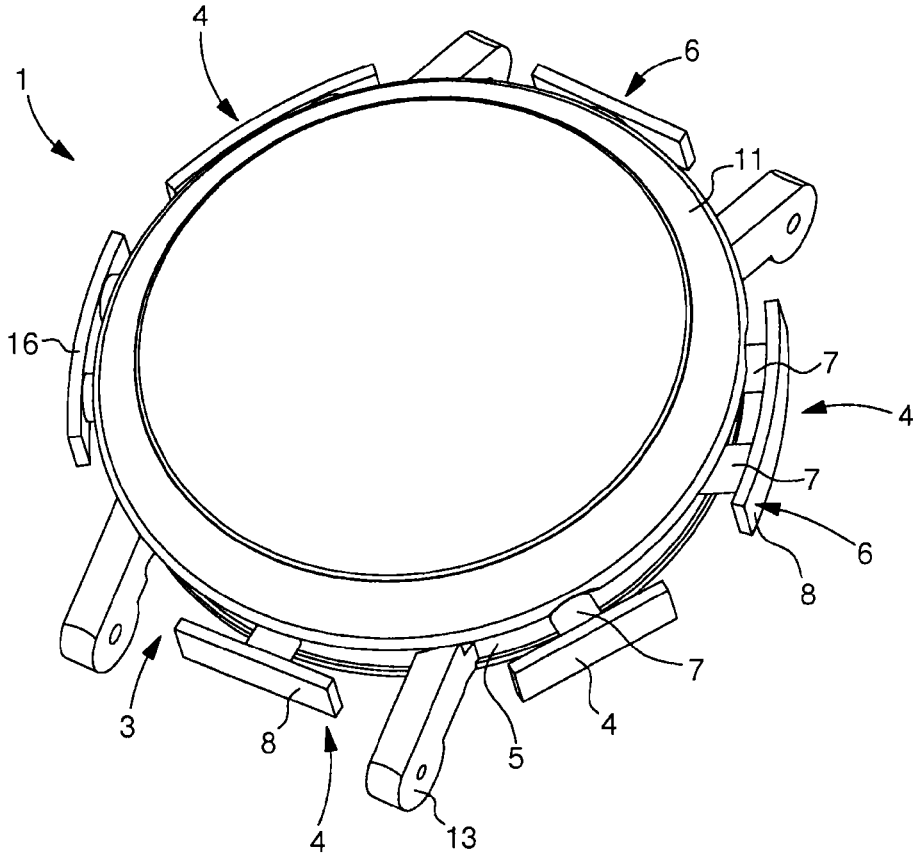
FIG. 1B shows a schematic, perspective view of a watch, optimised according to the invention, having acoustic radiators of different sizes with different attachment conditions, extending outside the watch case.

It is also possible, according to the invention, to form at least one such acoustic radiator 4 by making a partial cut-out in case middle 5 (or bezel 11 or another component of the case of the timepiece, notably a watch) in the form of a vibrating strip 8, connected to case middle 5 by a single end 9 of vibrating strip 8, as seen in FIG. 1A.

In a particular embodiment, at least one such acoustic radiator 4 is formed by making a partial cut-out in bezel 11, in the form of a vibrating strip 8, connected to bezel 11 by a single end 9 of vibrating strip 8.

In a particular embodiment, at least one such acoustic radiator 4 is formed by making a partial cut-out in back cover 12, in the form of a vibrating strip 8, connected to back cover 12 by a single end 9 of vibrating strip 8.

The invention also concerns external parts 3 for a timepiece 1 or for a musical or striking timepiece, notably for a watch, and more particularly for a musical or striking watch. These external parts 3 carry at least one vibration generator 2 vibrating at particular natural frequencies of the generator.

According to the invention, external parts 3 include at least one acoustic radiator 4, which includes at least one vibrating-radiating element, notably a vibrating strip 8, which vibrates at a natural frequency of the radiator tuned to at least one of the natural frequencies of the generator.

External parts 3 preferably include a case 10 enclosing at least a case middle 5 and at least one such acoustic radiator 4 is secured to case middle 5 or to case 10.

In particular variants, external parts 3 include at least one such acoustic radiator 4 on the exterior of case middle 5 or inside case 10.

In different variants, which may be combined with each other, and are seen in FIGS. 1A, 1B, 2A, 2B and 2C:

- at least one acoustic radiator 4 is arranged on the exterior of case middle 5;
- at least one acoustic radiator 4 is arranged on the exterior of a bezel 11 carried by case middle 5;
- at least one acoustic radiator 4 is arranged on the exterior of a back cover 12 comprised in case 10;
- at least one acoustic radiator 4 is arranged on one or two horns 13 comprised in case 10;
- at least one acoustic radiator 4 is arranged on a main plate 14 comprised in movement 17 of timepiece 1, this acoustic radiator 4 including a connecting component 15 traversing case 10 of timepiece 1;
- there is at least one acoustic radiator 4 which forms one-piece with its element of attachment to timepiece 1.

In the embodiment of FIG. 1B, at least one such acoustic radiator 4 is connected to case middle 5 or to case 10 by a single attachment leg 7, carrying at least one vibrating strip 8 comprised in acoustic radiator 4.

In the embodiment of FIG. 1A, at least one such acoustic radiator 4 includes at least one vibrating strip 8 cut from case middle 5 to which vibrating strip 8 is connected by a single end 9 of vibrating strip 8.

Preferably, external parts 3 include a plurality of such acoustic radiators 4, wherein at least a portion of acoustic radiators 4 have natural frequencies of the radiator that are different from each other.

The invention further concerns a timepiece 1 which is a striking watch and/or a musical box watch. The timepiece includes external parts 3 and/or a movement 17 carrying at least one vibration generator 2 vibrating at particular natural frequencies of the generator, these external parts 3 and/or this movement 17 including at least one acoustic radiator 4 including at least one element vibrating-radiating at a natural frequency of the radiator tuned to at least one of the natural frequencies of the generator of vibration generator 2.

Returning to acoustic radiators 4, preferably vibrating strips 8, notably additional plates, illustrated here in a non-limiting rectangular shape, are screwed in or soldered or driven on or secured by any method allowing transmission of acoustic vibration, to one or more components of the external parts, such as horns 13, bars, case middle 5, bezel 11, back cover 12, case 10 or even the bracelet links. These additional plates vibrate and radiate at their natural frequencies when the striking mechanism is released, or for a sound display, or simply to permanently ensure, in a selective manner, either amplification (resonance) or filtering (anti-resonance) of the noise emitted by a mechanism during operation. These vibrating elements function as the radiating plates forming acoustic radiators 4.

According to a first variant embodiment, acoustic radiators 4 are secured to movement 17 of timepiece 1, for example to main plate 14 of movement 17, instead of being secured to external parts 3. In this case, connecting members 7 are preferably components that traverse external parts 3 through openings sealed by sealing gaskets.

According to a second variant embodiment, acoustic radiators 4 and their connecting elements 7 form one-piece assemblies. Advantageously, at least one acoustic radiator 4 is thus made with a structural or external component, in a pre-assembly operation, which facilitates the final assembly of timepiece 1.

The shape of these acoustic radiators 4, the attachment conditions and the materials used define the natural frequencies of these elements, which are tuned to the natural frequencies of the striking system (notably gongs or vibration plate strips) or of the mechanism. FIGS. 1A and 1B show these acoustic radiators 4 secured, for example, to a case middle 5. FIG. 1B illustrates, in particular, acoustic radiators 4 of different sizes, with different attachment conditions, by means of one or more attachment legs 7, which naturally modifies their natural frequencies of the radiator.

FIG. 2A shows a second embodiment of the invention.

Figure 2B:
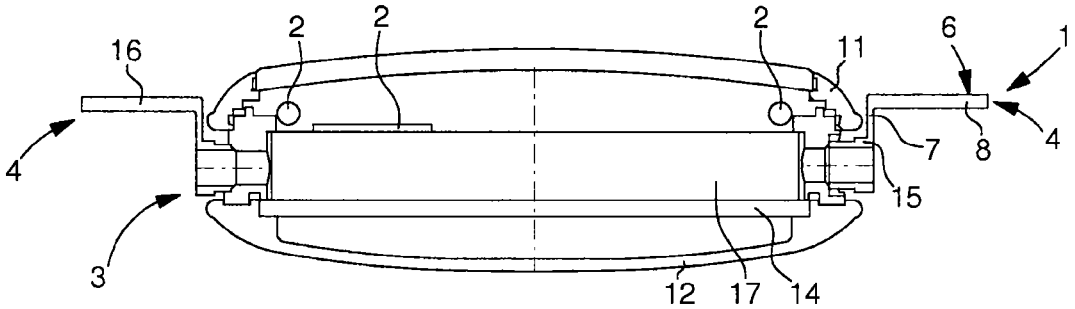
FIG. 2B shows a schematic cross-section, in a plane passing through a main axis, of the watch of FIG. 2A, including sound generators and acoustic radiators according to the invention.
Figure 2C:
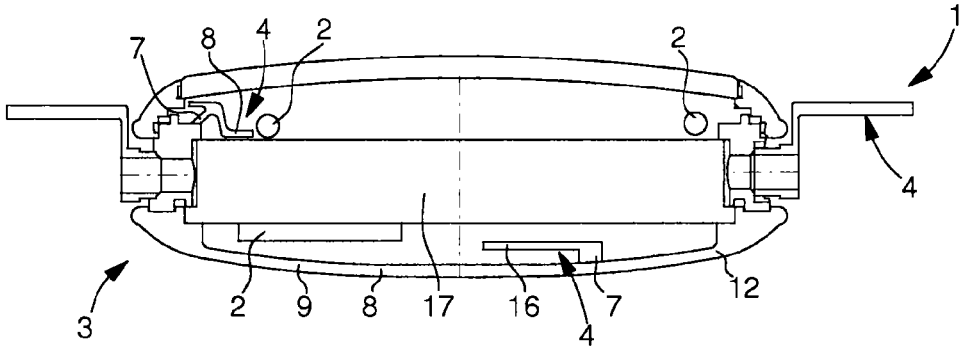
FIG. 2C shows, in a similar manner to FIG. 2B, another variant with acoustic radiators outside and inside the watch case.

FIGS. 2B and 2C illustrate two variants, the first only with acoustic radiators 4 external to the case, the second with acoustic radiators external and internal to the case.

According to a third embodiment (not illustrated), at least one acoustic radiator 4 is formed of a plate 8 whose shape is close to that of a crown or a spherical dome and whose connecting element 7 is fixed at the centre of plate 8.

The acoustic radiators may be made of gold, or of another precious metal, such as platinum or platinum group metals, or of an alloy of one or more of these precious metals. Alternatively, they may be made of steel. Alternatively, they may be made of titanium or titanium alloy. Alternatively, they may be made of silicon or silicon dioxide, or of polycrystalline diamond. Alternatively, they may be made of metallic glass, or of an at least partially amorphous alloy. Alternatively, they may be made of ceramic.

Advantageously, acoustic radiators 4 are made in the form of a vibrating strip 8 including a plate 16 inscribed in a parallelepiped whose largest dimension is greater than or equal to 4 mm, whose smallest dimension is comprised between 0.05 mm and 2 mm and whose third dimension is greater than or equal to 2 mm.

Advantageously, an acoustic radiator 4 includes a vibrating strip 8 which in turn includes at least one plate whose radii of curvature are greater than 0.5 mm.

Acoustic radiators 4 make it possible not only to increase the acoustic intensity of the timepiece, notably a watch 1, but also to optimise sound directivity. Indeed, the vibrating surface, or at least a main vibrating surface 6, can be oriented such that radiation is maximal in a particular desired direction. In an embodiment including several acoustic radiators 4, it is also possible to define a specific directivity for each note produced, thereby generating a stereophonic effect.

A vibroacoustic model was developed, within the scope of the invention, to correctly dimension acoustic radiators 4 and to predict the acoustic gain provided by these vibrating elements.

In the example embodiment of FIG. 3, acoustic radiators 4 were optimised so that their first natural modes had a frequency of 1350 Hz. Harmonic excitation scanning frequencies comprised between 1000 Hz and 3200 Hz is applied to external parts 3.

FIG. 3 shows the sound level of external parts 3 composed of a case middle 5 and of a bezel 11 with a crystal, respectively without acoustic radiators (continuous line) and with acoustic radiators 4 according to the invention (dash line) as a function of the excitation frequency applied thereto. In the configuration without radiators, the sound level increases to a frequency of more than 3 kHz, which corresponds to a frequency of one of the natural modes of external parts 3.

When acoustic elements 4 are added to external parts 3, the sound level increases considerably to the frequency of the first natural mode of the radiator (at 1350 Hz). The gain is 10 to 15 dB. The coupling between acoustic radiators 4 and external parts 3 appears at 1900 Hz, which also produces an improvement in sound level. The coupling between acoustic radiators 4 and the vibration modes of external parts 3 also introduces two anti-resonances at 1450 Hz and 2150 Hz, which also reduces sound emission in the rest of the band compared to the case without radiators, and thus filters noise produced by the mechanism.

In FIG. 4, the sound level of external parts 3 with acoustic radiators 4 (dash line) having a first natural mode at 2210 Hz is compared to that of the same external parts 3 without radiators (continuous line). Once again, acoustic radiators 4 provide a strong acoustic improvement at their first mode frequency.

Owing to these results, acoustic radiators 4 can be dimensioned for each of the frequencies generated by the sound, striking, alarm, musical or other system. The sound produced by the timepiece, notably a watch, can be optimised across a broad frequency band. Specific dimensioning of the radiators also makes it possible to filter noise from the mechanism.

In summary, the invention makes it possible to improve acoustic efficiency, not only with respect to the aforecited Patent Applications filed by the same Applicant, Montres Breguet SA, but also with respect to the aforecited FR Patent No 1136675A by Junhans, which together represent the most effective mechanisms until this invention: prior art embodiments have always encountered the difficulty of making a system (for example a clock) radiate at several independent frequencies within the 1 kHz to 6 kHz band, other than by a single resonance. Thus, in FR1136675Am the membrane radiation frequency coincides with the single radiation frequency of the equipment and therefore of the external parts.

The present invention introduces the solution of acoustic radiators, which are not membranes, which, conversely, makes it possible to add one or more additional radiation frequencies to the natural radiation frequency of the external parts of the system: the result, as shown in FIGS. 3 and 4, is that the frequencies of acoustic radiators 4 are added to the frequency of external parts 3, without destroying or replacing it, whereas in the prior art, only one resonance is visible—that of the system with the membrane.

The features of the invention constitute a novelty with respect to the prior art which was intended only to improve the radiation of the elements that form the external parts, such as the bezel-crystal assembly, the case middle or the back cover, or to cause the actual sound generating element to radiate.

In the case of the invention, the generating element does not necessarily radiate, and even advantageously remains non-radiating and physically distinct from the radiating element, which ensures a low damping rate and the purity of the vibration frequency (and therefore ultimately of the sound), while the radiating element is shifted to the external parts but is not part of the components forming the external parts, which ensure, in particular, the water-resistance of timepiece 1, especially in the case of a watch.

The invention is easy to implement, of moderate cost and provides numerous advantages with respect to the prior art:

improvement in the sound level of the sound radiated by a timepiece, notably a watch, in the frequency band between 1 kHz and 6 kHz;

possibility of individual and specific optimisation of acoustic radiators 4 to improve the overall sound level (in particular according to the melody or tuning of the gong).

this system does not impose any constraints on the design of the external parts:

water-resistance is not impaired since all the sealing gaskets can be retained, which is essential in any timepiece, particularly a water-resistant watch;

in certain embodiments, shock resistance and interior space do not need to be modified;

possibility of optimising the directivity of the sound produced by the timepiece, notably a watch 1, in a frequency-selective manner, and thus of obtaining stereophonic effects;

possibility of very economical production of acoustic radiators 4 by electroforming;

possibility of tuning the natural frequency of each acoustic radiator 4 to the frequency of a strip of a vibration plate or of a gong;

preserving the clarity of the sound emitted by the mechanism.

The invention claimed is:

1. A method for improving a sound level of a musical or striking timepiece including a least one vibration generator vibrating at particular natural frequencies of the generator within a range of 1 kHz to 6 kHz, wherein the external parts and/or a movement of the timepiece are modified by integration or addition of at least one radiating element formed by an acoustic radiator including at least one element vibrating-radiating at a natural frequency of the radiator tuned to one of the natural frequencies of the generator, with a frequency difference of less than or equal to the ratio between the natural mode frequency and the inverse quality factor of the radiating element, or with a frequency difference of less than or equal to 100 Hz, and wherein, to determine a number of the acoustic radiators, the method comprises:

determining a number of modes of vibration of the generating element, formed by the vibration generator which is required to radiate;

providing the timepiece with the number of radiating elements, each formed by one of the acoustic radiator including at least one vibrating-radiating element, each acoustic radiator being secured to an exterior of a case of the timepiece.

2. The method according to claim 1, wherein, for each acoustic radiator, the natural frequency of the radiator thereof is tuned to the natural frequency of the generator, with a frequency difference of less than or equal to the smallest value between (1) the ratio between the natural mode frequency and the inverse quality factor of the radiating element formed by the acoustic radiator concerned, and (2) a value of 100 Hz.

3. The method according to claim 1, further comprising verifying that the only function of each acoustic radiator is to radiate.

4. The method according to claim 3, wherein each acoustic radiator is oriented in a particular listening direction for which the timepiece is devised.

5. The method according to claim 3, wherein each acoustic radiator is optimized to ensure that the frequency of fundamental mode of vibration thereof is tuned to be substantially equal to that of one of the natural modes of vibration of the vibration generator with a frequency difference of less than or equal to the ratio between the natural mode frequency and the inverse quality factor of the radiating element, or with a frequency difference of less than or equal to 100 Hz.

6. The method according to claim 3, further comprising verifying that each acoustic radiator is distinct from the vibration generator.

7. The method according to claim 1, wherein the external parts or the movement are modified by the integration or addition of a plurality of the acoustic radiators.

8. The method according to claim 7, wherein at least a portion of the acoustic radiators are selected to have natural frequencies of the radiator that are different from each other.

9. The method according to claim 1, wherein at least one of the acoustic radiator including a main vibrating surface oriented in a preferred direction to enhance diffusion of sound towards a user.

10. The method according to claim 1, wherein at least one of the acoustic radiator is secured to a case middle in the external parts, or to a case in the external parts, or to a bezel carried by the case middle, or to a main plate in movement of the timepiece.

11. The method according to claim 10, wherein at least one of the acoustic radiator is arranged on an exterior of the case middle.

12. The method according to claim 10, wherein at least one of the acoustic radiator is arranged on an exterior of a bezel carried by the case middle.

13. The method according to claim 10, wherein at least one of the acoustic radiator is arranged on an exterior of a back cover in the case.

14. The method according to claim 10, wherein at least one of the acoustic radiator is arranged on one or two horns in the case.

15. The method according to claim 10, wherein at least one of the acoustic radiator is arranged on a main plate in a movement of the timepiece, the acoustic radiator including a connecting component traversing the case of the timepiece.

16. The method according to claim 1, wherein at least one of the acoustic radiator forms a one-piece part with an element for attachment thereof to the timepiece.

17. The method according to claim 10, wherein at least one of the acoustic radiator is connected to the case middle or to the case or to a movement by a single attachment leg carrying at least one vibrating strip in the acoustic radiator.

18. The method according to claim 10, wherein at least one of the acoustic radiator is formed by making a partial cut-out in the case middle, in a form of a vibrating strip, connected to the case middle by a single end of the vibrating strip.

19. The method according to claim 12, wherein at least one of the acoustic radiator is formed by making a partial cut-out in the bezel, in a form of a vibrating strip, connected to the bezel by a single end of the vibrating strip.

20. The method according to claim 13, wherein at least one of the acoustic radiator is formed by making a partial cut-out in the back cover, in a form of a vibrating strip, connected to the back cover by a single end of the vibrating strip.

21. The method according to claim 1, wherein at least one of the acoustic radiator is made in a form of a vibrating strip including a plate inscribed in a parallelepiped whose largest dimension is greater than or equal to 4 mm, whose smallest dimension is between 0.05 mm and 2 mm, and whose third dimension is greater than or equal to 2 mm.

22. The method according to claim 1, wherein at least one of the acoustic radiator includes a vibrating strip including a plate whose radii of curvature are greater than 0.5 mm.

23. The method according to claim 1, wherein the at least one acoustic radiator is made of gold, or of precious metal, or of silicon, or of ceramic, or of metallic glass, or of steel, or of titanium.

24. External parts for a musical or striking timepiece, the external parts carrying at least one vibration generator vibrating at particular natural frequencies of the generator, wherein the external parts include at least one acoustic radiator including at least one element vibrating-radiating at a natural frequency of the radiator tuned to at least one of the natural frequencies of the generator of the timepiece, wherein the external parts include a case enclosing at least one case middle, wherein at least one the acoustic radiator is secured to the case middle or to the case, wherein at least one the acoustic radiator is connected to the case middle or to the case by a single attachment leg carrying at least one vibrating strip in the acoustic radiator.

25. The external parts according to claim 24, wherein the external parts include at least one of the acoustic radiator on an exterior of the case middle or inside the case.

26. The external parts according to claim 24, wherein the external parts include a plurality of the acoustic radiators, wherein at least a portion of the acoustic radiators have natural frequencies of the radiator that are different from each other.

27. External parts for a musical or striking timepiece, the external parts carrying at least one vibration generator vibrating at particular natural frequencies of the generator, wherein the external parts include at least one acoustic radiator including at least one element vibrating-radiating at a natural frequency of the radiator tuned to at least one of the natural frequencies of the generator of the timepiece, wherein the external parts include a case enclosing at least one case middle, wherein at least one of the acoustic radiator is secured to the case middle or to the case, wherein at least one of the acoustic radiator includes at least one vibrating strip cut from the case middle to which the vibrating strip is connected by a single end of the vibrating strip.

28. The external parts according to claim 27, wherein the external parts include at least one of the acoustic radiator on an exterior of the case middle or inside the case.

29. The external parts according to claim 27, wherein at least one of the acoustic radiator is connected to the case middle or to the case by a single attachment leg carrying at least one vibrating strip in the acoustic radiator.

30. The external parts according to claim 27, wherein the external parts include a plurality of the acoustic radiators, wherein at least a portion of the acoustic radiators have natural frequencies of the radiator that are different from each other.

31. A timepiece, which is a striking watch and/or a musical box watch, comprising the external parts according to claim 27, and/or a movement carrying at least one vibration generator vibrating at particular natural frequencies of the generator, the movement including at least one acoustic radiator including at least one element vibrating-radiating at a natural frequency of the radiator tuned to at least one of the natural frequencies of the generator.

* * * * *